US005329750A

United States Patent [19]

Bagley et al.

[11] Patent Number: 5,329,750

[45] Date of Patent: Jul. 19, 1994

[54] BLISTER PACKAGING MACHINERY

[76] Inventors: Stuart C. Bagley, 801 San Salvador Dr., Dunedin, Fla. 34698; Jon L. McCanless, 802 Tomahawk Trail, Brandon, Fla. 33511; Robert W. Singleton, 2910 Barret Ave., Plant City, Fla. 33567

[21] Appl. No.: 975,622

[22] Filed: Nov. 12, 1992

[51] Int. Cl.[5] ..... B65B 7/28; B65B 41/08; B65B 43/48; B65B 51/22

[52] U.S. Cl. ..... 53/559; 53/281; 53/300; 53/389.1

[58] Field of Search ..... 53/559, 453, 449, 170, 53/373.7, 374.2, 374.8, 281, 300, 389.1

[56] References Cited

U.S. PATENT DOCUMENTS

| | | | |
|---|---|---|---|
| 3,118,262 | 1/1964 | Messick | 53/559 |
| 3,195,284 | 7/1965 | Crane, Jr. | 53/559 X |
| 3,397,508 | 8/1968 | Stroop | 53/559 |
| 3,464,182 | 9/1969 | Nichols | 53/559 |
| 3,660,962 | 5/1972 | Bliss et al. | 53/559 X |
| 3,874,143 | 4/1975 | Braber | 53/559 X |
| 3,946,537 | 3/1976 | Hair et al. | 53/559 |
| 4,233,801 | 11/1980 | Watt | 53/453 |
| 4,490,963 | 1/1985 | Knudsen | 53/559 |

*Primary Examiner*—Horace M. Culver
*Attorney, Agent, or Firm*—Michael J. Colitz, Jr.

[57] ABSTRACT

Apparatus for fabricating blister packs comprising a first support for a web of plastic material located at the input end of the apparatus; a feeder to feed the web of plastic material along a path of travel through the apparatus to the output end thereof; a former means along the path of travel to form wells in a conveyed web of plastic material; dispensers means along the path of travel to dispense pills into the wells; a second support for a web of rupturable material located above the linear path of travel to feed rupturable material onto the plastic material for movement therewith in a two part laminate; a tray for a stack of cards laterally offset from the path of travel; a conveyor to sequentially feed cards from the support means to a location adjacent to the web of plastic material and then into contact therewith; a coupler along the path of travel to couple the plastic material with the cards to form a three part laminate; and a cutter along the linear path of travel to cut the laminate for forming individual blister packs.

8 Claims, 7 Drawing Sheets

BLISTER PACKAGING MACHINERY

BACKGROUND OF THE INVENTION

1. Field of the Invention

The present invention relates to blister packing machinery and, more particularly, to apparatus for first creating a two-layer laminate constituting a blister pack for pills or the like and additional apparatus to feed information-bearing cards into association with the two-layer laminate and to ultrasonically weld the cards onto the two-layer laminate to thereby form a three-part laminate which is then cut to size, all in a continuous and automatic cycle of operation.

2. Description of the Background Art

One common technique for packaging and merchandising pills or the like is the blister pack. A blister pack is a card containing a plurality of pills which may be individually pushed out from the card for consumption. In association with such blister packs, it has been a common practice to attach an information-bearing card with data relating to the contents of the particular pill or pills to be dispensed therefrom. Since each pill within the blister pack may be different than all others, there is an increased need to place the information-bearing card onto the blister pack in the proper orientation to insure proper consumption.

Conventional blister packaging machinery includes an automatic assembly line which generates the blister pack. The blister packs are formed from two continuous webs of material. A base or lower web is formed from a sheet of plastic material which is deformed to create wells, each for receiving one pill. Coupled thereto is a web of rupturable material, the lid, through which the pills in the wells may be dispensed. It is a common practice for machinery to generate such blister packs in a continuous cycle of operation. It is also a common practice to cut the blister packs into a proper size as they come off the line and then to manually attach a single information-bearing card to each blister pack.

Various attempts have been made to automate fabrication of blister packs to one extent or another. By way of example, U.S. Pat. No. 2,970,414 to Rohdin discloses apparatus for forming, filling and sealing blister packs. Such apparatus includes a card feeding station which deposits a single information-bearing card over each set of pills of a single blister pack. The blister packs are then cut by a device separating each blister pack from its next following blister pack, transverse to the path of travel through the apparatus. There is no teaching of continuous and automatic machinery which feeds information-bearing cards onto the lower surface of a two-layer blister pack laminate and which then seals together the three-layer blister pack laminate.

A second prior patent, U.S. Pat. No. 3,464,182 to Nichols also discloses a machine for forming blister packs. The blister packs are formed by a base sheet and a cover sheet with pills therebetween. The cover sheet is preferably formed of cardboard with printed material preformed on the surface of the sheets.

Other patents and interests include U.S. Pat. No. 4,498,588 to Scott and U.S. Pat. No. 4,918,907 to Roach. The Scott patent discloses a method for forming a reclosable packaging system while Roach discloses packaging apparatus for forming and filling flexible packages. The apparatus includes a cover unit and cutter. Other prior patents disclosing blister packaging machinery include U.S. Pat. Nos. 3,118,262 to Messick; 3,874,143 to Braber and 4,506,495 to Romagnoli.

All of the known background patents disclose one technique or another for improving blister packages or machines for fabricating blister packs. No prior art patent, however, discloses efficient, reliable, inexpensive apparatus for fabricating three-layer blister packs with information bearing cards secured by ultrasonic welding in the improved continuous and automatic manner as disclosed herein.

The present invention achieves its intended purposes, objects, and advantages through a new, useful and unobvious combination of component elements, with the use of a minimum number of functioning parts, at a reasonable cost to manufacture, and by employing only readily available materials.

Therefore, it is an object of this invention to provide a system for fabricating blister packs containing pills to be individually dispensed therefrom, the system comprising a first reel for supporting a web of plastic material located adjacent to the input end of the system, the plastic material constituting the lid material of the blister packs; intermittent drive means located adjacent to the output end of the system to feed the plastic material and associated material in a step and repeat manner along a linear path of travel through the system; well forming means along the path of travel downstream from the first reel adapted to form individual pill receiving wells in a conveyed web of plastic corresponding to a plurality blister packs extending transversely across the web of plastic material; dispensing means along the path of travel downstream from the well forming means adapted to dispense individual pills into the individual wells: a second reel for supporting a web of rupturable material located above the path of travel downstream from the dispensing means to feed rupturable material onto the web of plastic material for movement therewith, the rupturable material constituting the lid material of the blister pack; heating means located along the path of travel downstream from the second reel to fuse the plastic material to the rupturable material with pills therebetween and thereby form a two-part laminate; support means downstream from the heating means and laterally offset from the path of travel for retaining a stack of apertured information-bearing cards in an operative orientation for being fed therefrom; pick and place means with associated rail means located between the support means and the path of travel adapted to sequentially pick information-bearing cards from the support means and to place the picked card onto the rail means adjacent to, but offset from, the path of travel; piston means located beneath the rail means adapted to shift the placed card to a location beneath the web of plastic material with the wells of the plastic material vertically aligned with the apertures of the card; ultrasonic welding means along the path of travel adapted to raise the shifted card into contact with the plastic material and to couple the plastic material, with the rupturable material thereabove, with the raised card therebeneath to form a three part laminate: punching means along the path of travel downstream from the ultrasonic welding means to cut the laminate along the path of travel and transverse thereto for forming blister packs in a continuous and automatic cycle of operation; and third reel means located along the path of travel adjacent to the output means to receive the remaining material of the three-part laminate after the cutting of the blister packs therefrom.

It is a further object of the present invention to continuously and automatically couple information-bearing cards to blister packs by ultrasonic welding.

It is a further object of the present invention to ensure the proper placement of information-bearing cards on a blister pack so that the specific information properly represents the particular pills in the blister pack.

It is a further object of the present invention to abate errors of card placement onto blister packs through an automated process.

The foregoing has outlined some of the more pertinent objects of this invention. These objects should be construed to be merely illustrative of some of the more prominent features and applications of the present invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with the specific embodiment shown in the attached drawings. For the purpose of summarizing the invention, the invention may be incorporated into an apparatus for fabricating blister packs. The apparatus comprises a first support for a web of plastic material located at the input end of the apparatus. Further, feed means are included in the apparatus. The feed means feeds the web of plastic material along a path of travel through the apparatus to the output end thereof. Additionally, forming means are provided along the path of travel to form wells in a conveyed web of plastic material. Subsequently, a dispensing means is positioned along the path of travel to dispense pills into the wells. A second support for a web of rupturable material is located above the linear path of travel. The second support feeds rupturable material onto the plastic material for movement therewith in a two part laminate. A tray means is further included for a stack of cards laterally offset from the path of travel. A conveyor means sequentially feed cards from the support means to a location adjacent to the web of plastic material and then into contact therewith. The apparatus includes coupling means along the path of travel to couple the plastic material with the cards to form a three part laminate. Finally, cutting means are provided. The cutter means is positioned along the linear path of travel for cutting the laminate to form individual blister packs.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present invention. It should be realized by those skilled in the art that such equivalent methods and structures do not depart from the spirit and scope of the invention as set forth in the appended claims.

BRIEF DESCRIPTION OF THE DRAWINGS

For a fuller understanding of the nature and objects of the present invention, reference should be had to the following detailed description taken in conjunction with the accompanying drawings in which:

FIG. 3E is an enlarged perspective view of the mechanisms for transferring cards from the pick and place apparatus to the welding station.

Similar reference characters refer to similar parts throughout the several Figures.

DETAILED DESCRIPTION OF THE PREFERRED EMBODIMENT

Figure 2:
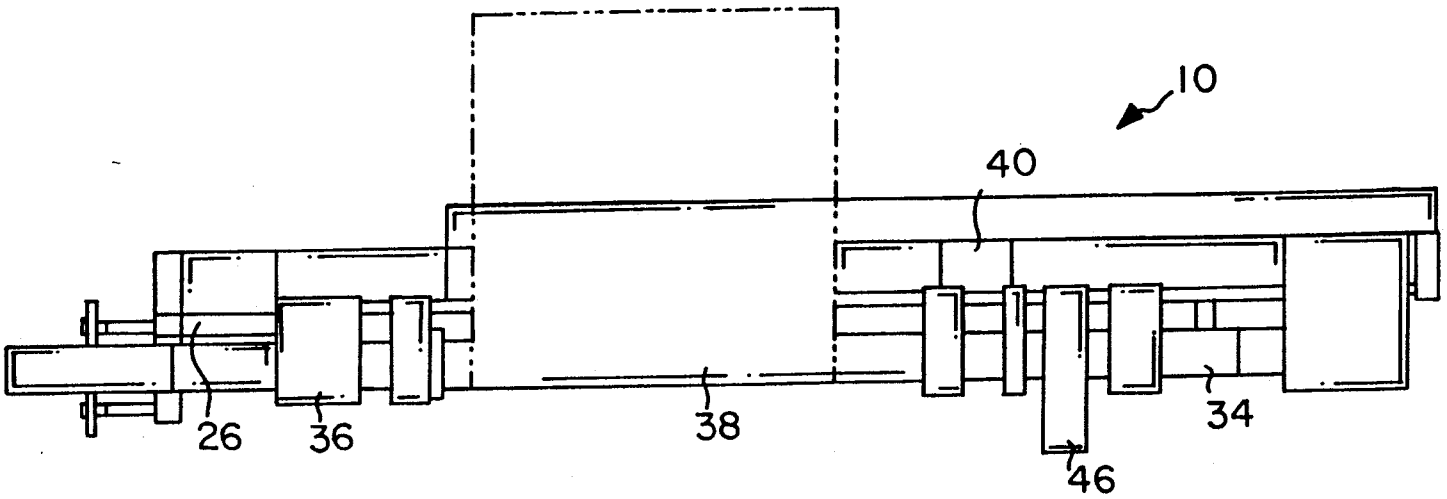
FIG. 2 is a plan view of the primary embodiment of the system for fabricating blister packs.
Figure 1:
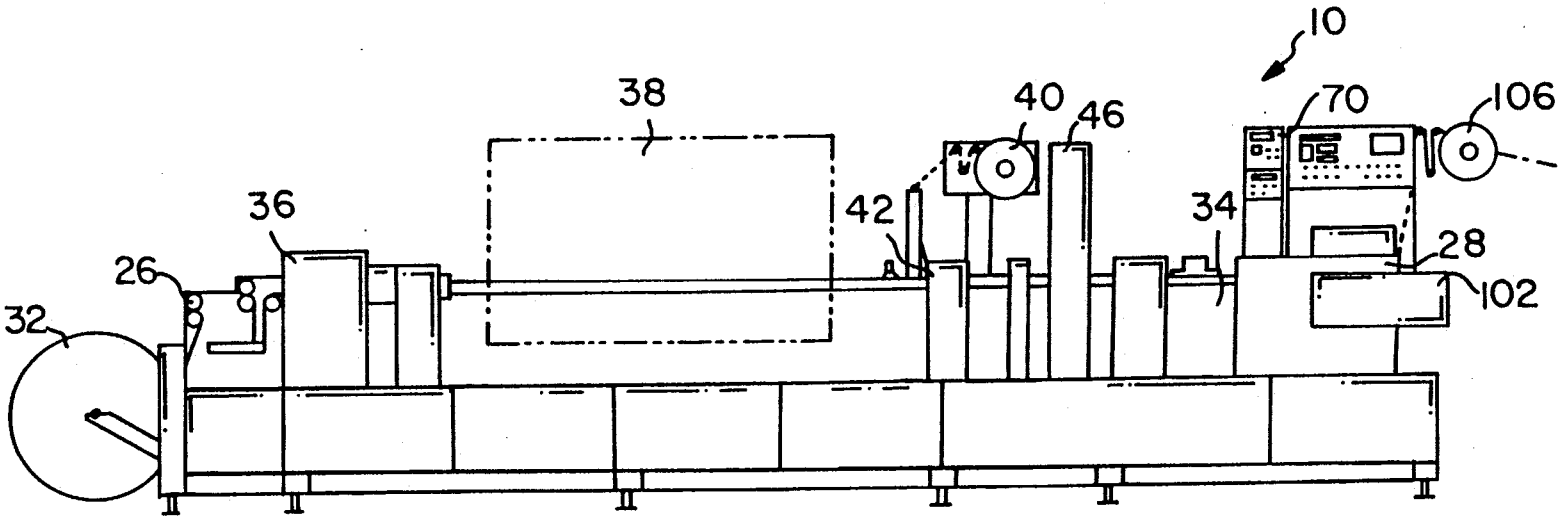
FIG. 1 is a side elevational view of the primary embodiment of the system for fabricating blister packs.
Figure 3A:
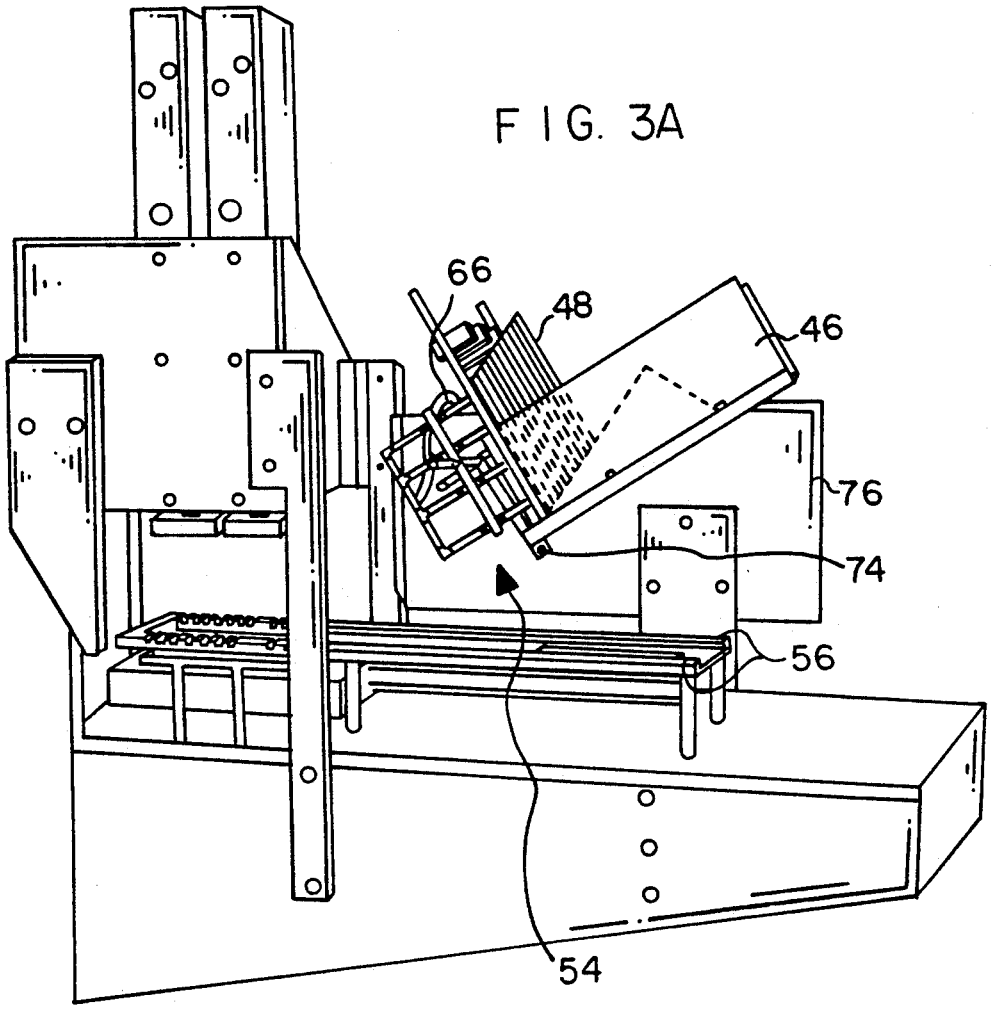
FIGS. 3A through 3E are perspective views of the pick and place apparatus showing the range of operation thereof.
Figure 3B:
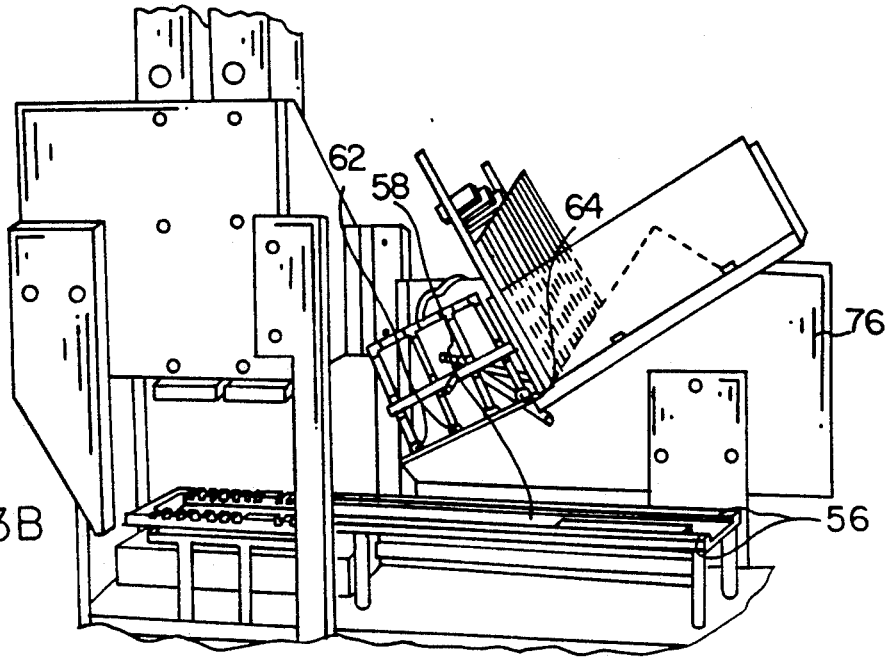
Figure 3C:
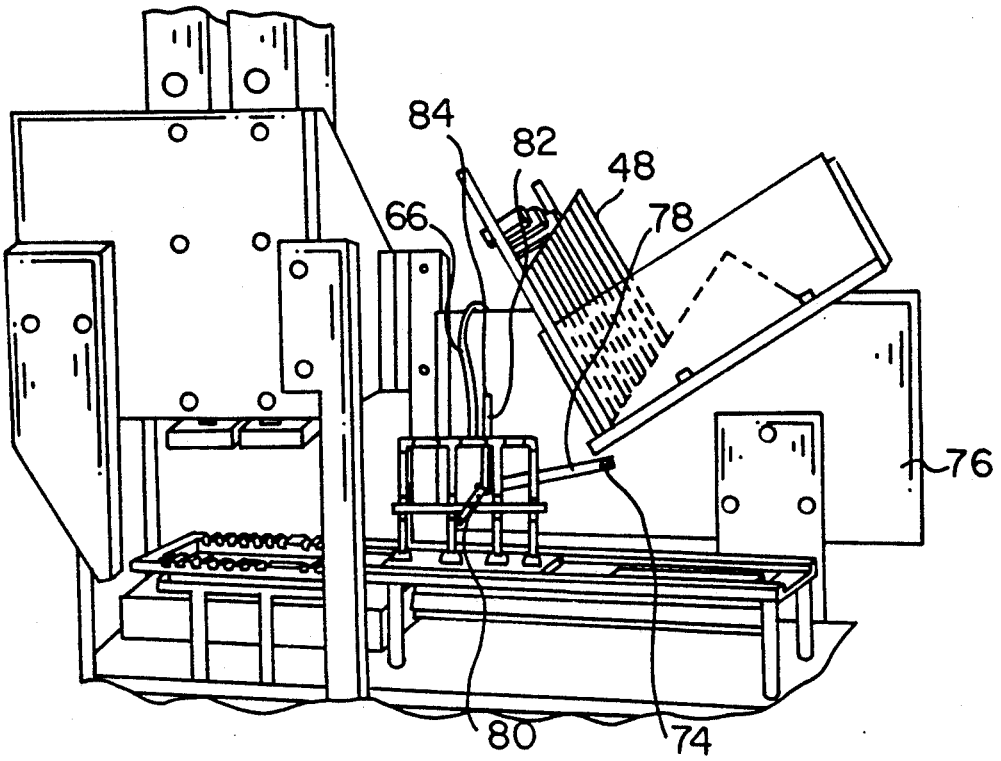
Figure 3D:
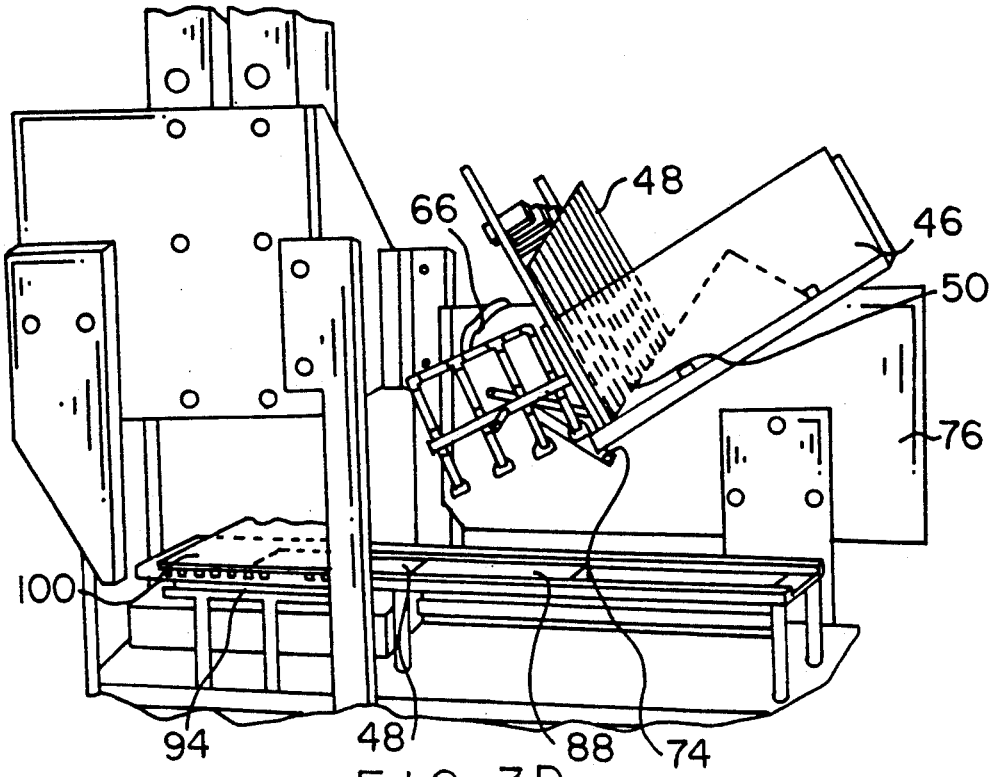
Figure 3E:
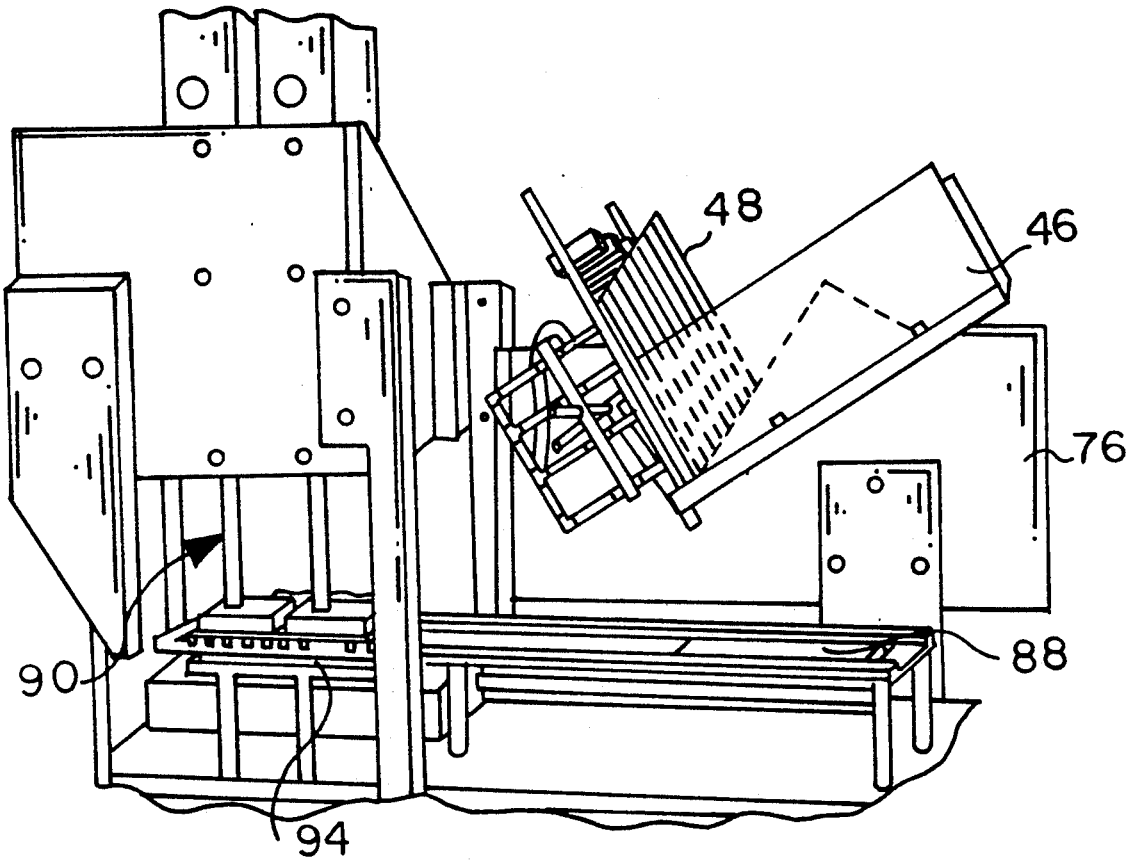
Figure 3F:
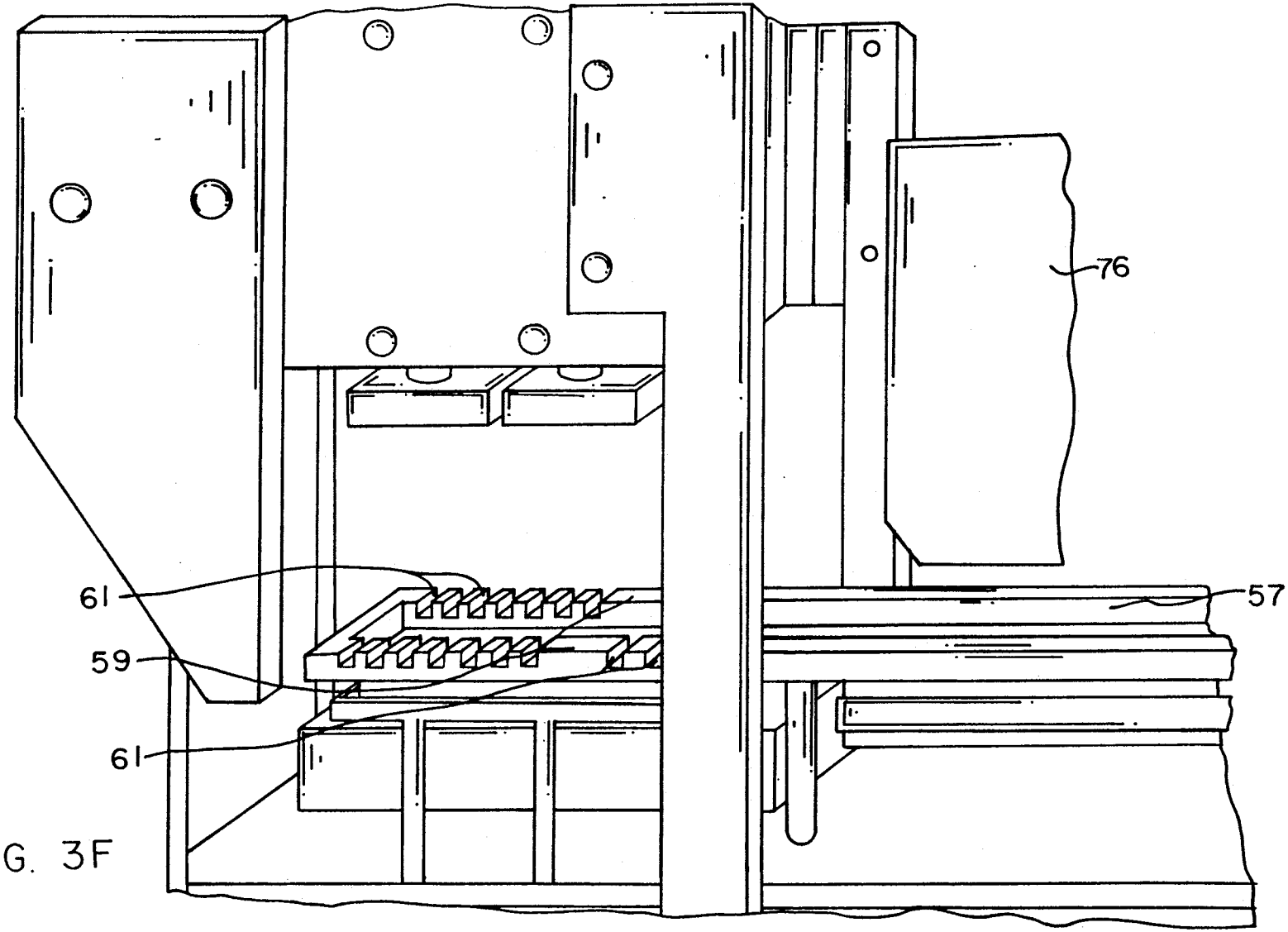
Figure 5:
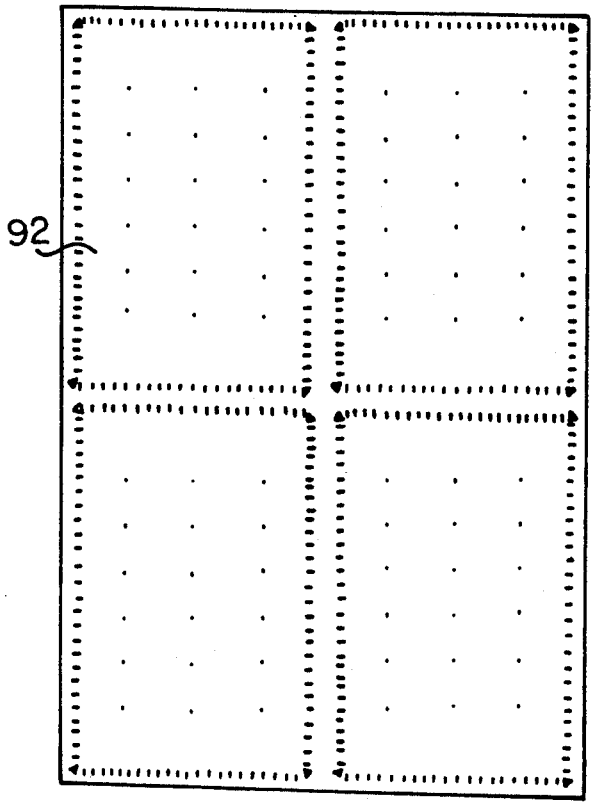
FIG. 5 is a plan view illustrating the composite information-bearing card.
Figure 4:
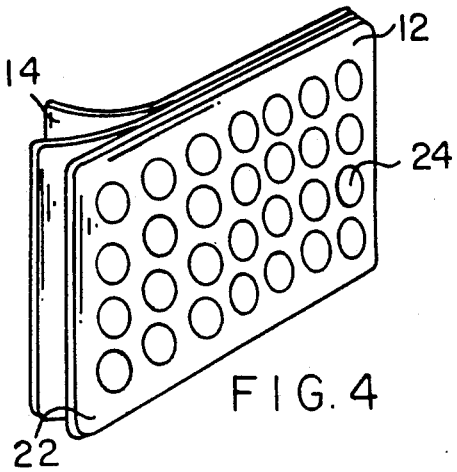
FIG. 4 is perspective view of the blister pack showing the layers thereof.
Figure 6:
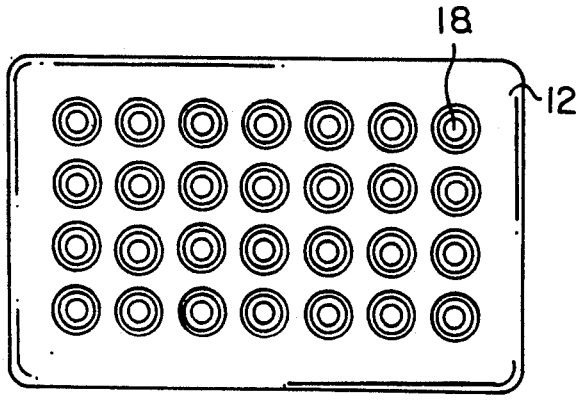
FIG. 6 is a plan view illustrating the blister pack having a plurality of pills therein.
Figure 7A:
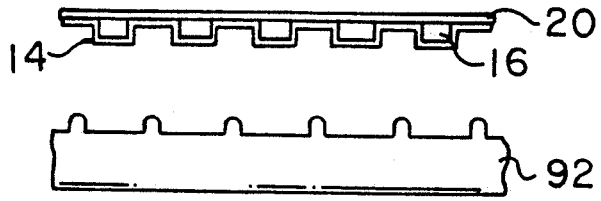
FIGS. 7A through 7D are side elevational views of the ultrasonic welding means showing the operational range thereof.
Figure 7B:
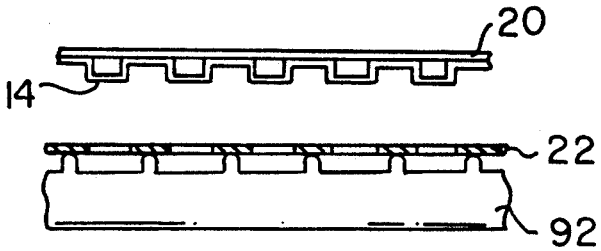
Figure 7C:
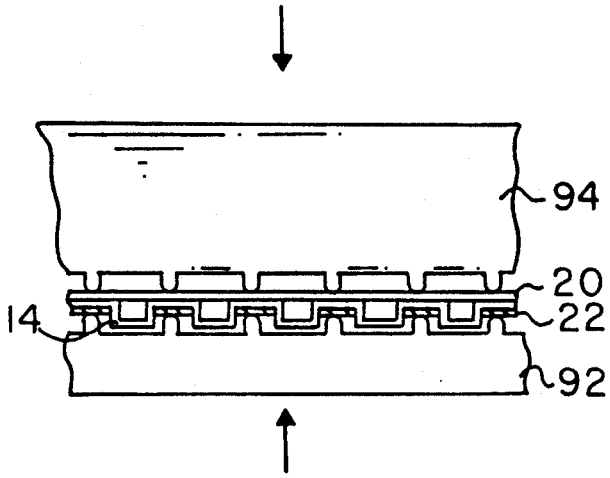
Figure 7D:
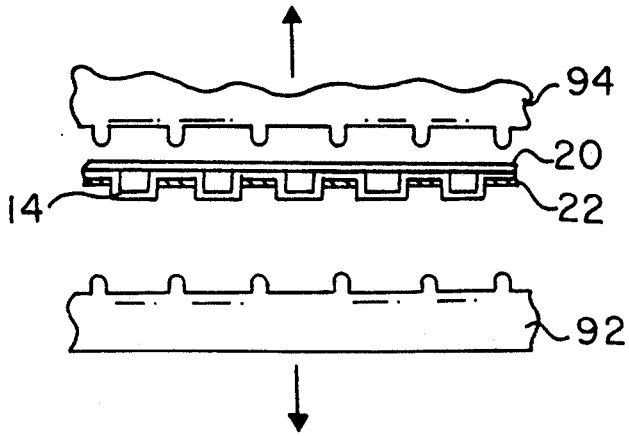

Shown in FIGS. 1 and 2 is a machine or apparatus 10, constructed in accordance with the principles of the present invention, and adapted to fabricate blister packs 12 in a continuous and automatic cycle of operation. By way of background, a typical blister pack is shown in FIG. 6. The blister pack includes a first layer 14 of stiff plastic material, the base. Wells 16 are formed in the base for containing individual pills 18 to be dispensed. A lid of a rupturable layer 20 is secured over the base to hold the pills in the wells. The individual pills are dispensed from the wells as the lid is ruptured by the user pushing the wells toward the lid. Together the base and lid form a two part laminate. Over the base is an information bearing card 22 ultrasonically welded to the base to form a three part laminate. The information bearing card provides information to be read by a user for indicating data relating to the pill or pills.

The apparatus 10 is actually a system for fabricating blister packs in a continuous and automatic manner. The system is adapted to feed the component materials of the blister pack in a linear path of travel from an input end 26 to an output end 28 and comprises a first reel 32 for supporting a web of plastic material adjacent to the input end of the system. The plastic material constitutes the base material of the blister packs.

A drive means 34 is located adjacent to the output end of the system. The drive means is an intermittent driver which functions to feed the plastic base material, as well as any of its attached and associated materials, in a step and repeat manner, along the linear path of travel through the system. This is accomplished by grasping the material being fed on opposite sides of the path of travel and pulling the grasped segment for a predetermined distance equal to one, two, three or more blister packs. The length of the distance pulled is a function of the particular application. In the disclosed preferred embodiment, the pull equals two blister pack lengths for facilitating the subsequent operational steps. After pulling the fed material the predetermined distance, the drive means releases the material, moves rearwardly along the path of travel while the material is stopped, grasps a following portion of the fed material and then forwardly pulls another length of the material along the path of travel. This operation, as well as the other operations performed by the system, are repeated in a continuous and automatic cycle of operation Along the path of travel, downstream from the first reel, and adapted to form individual pill receiving wells in the conveyed web of plastic, is a well forming means 36. The formed wells correspond to a plurality blister packs equivalent to the predetermined segment of material. In the disclosed preferred embodiment, the segment is two blister packs in length and two wide, two extending along, and two transversely across, the web of material. The well forming means comprises a plurality of projections and a corresponding number of axially aligned recesses, all of a number, size, shape and position corresponding to the wells to be formed in the base material.

A pill dispenser 38 for the individual pills is next positioned along the path of travel downstream from the well forming means. The pill dispenser is adapted to dispense individual pills into the individual wells according to a preselected program.

A second reel 40 supports a web of rupturable material 20. The second reel is located above the path of travel downstream from the pill dispenser and functions to feed the web of rupturable material onto the web of plastic material for movement therewith. The rupturable material constitutes the lid material of the blister packs.

Heating means 42 in the form of opposed heating platens is located along the path of travel downstream from the second reel. The heater functions to fuse the plastic material to the rupturable material with pills therebetween and thereby form a two-part laminate.

Downstream from the heating means and laterally offset from the path of travel is a support tray 46. The support tray is adapted to retain a stack of apertured information-bearing composite cards 48 in an operative orientation for being fed from an aperture 50 in the bottom of the support tray 46. The location of the pick and place apparatus with its card support tray for feeding cards 48 transverse the path of travel of the web of the blister pack layers can be readily seen by comparing FIGS. 3A–F with FIGS. 1 and 2. Each composite card 48 is actually a plurality of individual blister pack cards previously formed en masse which are later cut with the other layers of the blister packs in the blister packaging machinery to form individual blister packs 12. Each composite card forms one of the three layers of the finished blister packs. The plurality of individual information bearing cards are in a rectangular configuration on the composite information bearing card, two along the path of travel and two across the path of travel. Other arrangements of individual cards on a composite information-bearing card could readily be utilized as a function of the particular application.

A pick and place assembly 54 with associated rails is located between the support tray 46 and the path of travel of the blister pack materials. The pick and place assembly is adapted to sequentially pick individual composite information-bearing cards 48 from the support tray 46 and to place the picked card onto rails 56 of a fixed plate 58 to an elevation beneath the path of travel. The rails are adjacent to, but offset from, the path of travel. Additionally, the rails include narrowly spaced rails 57 remote from the path of travel for receiving the composite cards and widely spaced rails 59 below the path of travel to accommodate the coupling means. The rails support the edges of the card perpendicular to the path of travel for being slid to a location beneath the path of travel.

In the disclosed preferred embodiment, recesses 61 are formed in the widely spaced rails traverse the path of travel. The recesses allow the wells formed in the web of plastic material to move along the path of travel. Alternately, there are recesses in two sets of rails transverse to the path of movement to accommodate two transverse blister packs formed in the common web of material.

The pick and place assembly 54 employs a plurality of hollow sniffer tubes 62 with free ends 64. Associated hollow tubes 66 allow a source of negative pressure to create a vacuum at openings in the free ends of the sniffer tubes. A control system 70 provides the logic for the entire blister packaging machinery and also functions to activate and inactivate the source of pressure and to move the sniffer tubes in an appropriate path of movement whereby the free ends of the sniffer tubes will pick the bottom-most card from the support means, convey it to the rails and place it on the rails for further movement.

Movement of the sniffer tubes is effected by a drive hub 74. The drive hub is mounted in a fixed back plate 76 for oscillating motion. A drive rod 78 is secured to, and extends from, the drive hub for being driven thereby. The drive rod is rotatably coupled with a manifold rod 80 which supports the sniffer tubes. Manifold rod 80 is secured to the first end of guide rod 82. The first end of the guide rod is rotatably coupled with respect to the drive rod. The second end of the guide rod is slidably received in a freely oscillatable guide hub 84 which is, in turn, also mounted on the fixed back plate. Oscillation of the drive hub 74 functions to oscillate the free end of the drive rod 78, manifold rod, the manifold and the sniffer tubes. When this is taken in association with the oscillation of the first end of the guide rod 82 and the axial reciprocation of the second end of the guide rod 82, the second end of the guide rod 82 will impart the desired compound motion to the manifold rod, manifold and sniffer tubes.

The above components of the blister packaging machinery, as described above are conventional, except for the mechanisms for the pick and place assembly. Such machinery is manufactured by MGS Machine Corporation of Maple Grove, Minn. Further details of such machinery may be had by reference to sales information from MGS Machine Corporation.

Movement of the information-bearing composite cards along the rails after placement by the pick and place assembly is effected by a piston 88. The piston is located beneath the rails and is adapted to push the placed composite card by an upstanding finger to a location beneath the web of plastic material 96. The piston positions each composite card such that the wells of the plastic material are vertically aligned with the apertures 24 of the card in the path of travel.

The above components of the blister packaging machinery, as described above are conventional, except for the mechanisms for movement of the information-bearing composite cards. Such machinery is manufactured by Origa Corporation of Elmhurst, Ill. Further details of such machinery may be had by reference to sales information from Origa Corporation.

Operably positioned in association with the rails is ultrasonic welder 90. The ultrasonic welder comprises a bottom plate 92 and a top plate 94 positioned along the path of travel thereabove and therebeneath. The welder has a base beneath the path of travel which is adapted to raise the shifted composite card into contact with the plastic material 96. The welder also has a head above the path of travel which lowers into contact with the lid of the blister pack. With the three layers of material in superposed contact, the head of the welder is energized to ultrasonically couple the layers one to another. The head has downwardly extending projections whereby the coupling is effected at the locations of the projections, around the periphery of the cards and between the various wells. The welding thus couples the materials such that the rupturable material is above the plastic material and the raised card is beneath the plastic material to form a three part laminate 100.

The above components of the blister packaging machinery, as described above are conventional, except for the mechanisms for welding the materials together. Such machinery is manufactured by Branson Ultrasonics Corporation of Danbury, Conn. Further details of such machinery may be had by reference to sales information from Branson Ultrasonics Corporation.

Subsequent to welding, the three part laminate is received by a punch 102. The punch is positioned along the path of travel downstream from the ultrasonic welder. The puncher cuts the laminate along the path of travel and transverse thereto for forming individual blister packs which are lowered to a receiving tray therebeneath. Remaining on the path of travel is the web with its three layers of material. The web includes holes, interior of its edges, the holes being in a configuration of the final blister packs previously removed. The puncher provides for forming blister packs in a continuous and automatic cycle of operation.

Finally, the apparatus includes a third reel 106. The third reel is located adjacent to the output means along the path of travel. It is a driven roll for receiving the remaining material of the three-part laminate of the web after the cutting of the blister packs therefrom.

The above components of the blister packaging machinery, as described above are conventional, except for the mechanisms for feeding and applying the information bearing cards. Such machinery is manufactured by Klockner Borsch Machinery Sales and Service of Clearwater, Fla. Further details of such machinery may be had by reference to sales information from Klockner Borsch Machinery Sales and Service.

The present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A system for fabricating blister packs containing pills to be individually dispensed therefrom, the system having an input end and an output end and comprising:

a first reel for supporting a web of plastic material located adjacent to the input end of the system, the plastic material comprising the lid material of the blister packs;

intermittent drive means located adjacent to the output end of the system to feed the plastic material in a step and repeat manner along a linear path of travel through the system;

well forming means along the path of travel downstream from the first reel adapted to form individual pill receiving wells in a conveyed web of plastic corresponding to a plurality blister packs extending transversely across the web of plastic material;

dispensing means along the path of travel downstream from the well forming means adapted to dispense individual pills into the individual wells;

a second reel for supporting a web of rupturable material located above the path of travel downstream from the dispensing means to feed rupturable material onto the web of plastic material for movement therewith, the rupturable material constituting the lid material of the blister packs;

heating means located along the path of travel downstream from the second reel to fuse the plastic material to the rupturable material with pills therebetween and thereby form a two-part laminate;

support means downstream from the heating means and laterally offset from the path of travel for retaining a stack of apertured information-bearing cards in an operative orientation for being fed therefrom;

pick and place means with associated rail means located between the support means and the path of travel adapted to sequentially pick information-bearing cards from the support means and to place the picked card onto the rail means adjacent to, but offset from, the path of travel;

piston means located beneath the rail means adapted to shift the placed card to a location beneath the web of plastic material with the wells of the plastic material vertically aligned with the apertures of the card and with support rails for the plastic material, the support rails having recesses for the wells;

ultrasonic welding means along the path of travel adapted to raise the shifted card into contact with the plastic material and to couple the plastic material, with the rupturable material thereabove, with the raised card therebeneath to form a three part laminate;

punching means along the path of travel downstream from the ultrasonic welding means to cut the laminate along the path of travel and transverse thereto for forming blister packs in a continuous and automatic cycle of operation; and third reel means located along the path of travel adjacent to the output means to receive the remaining material of the three-part laminate after the cutting of the blister packs therefrom.

2. Apparatus for fabricating blister packs comprising:

a first support for a web of plastic material located at the input end of the apparatus;

feed means to feed the web of plastic material along a path of travel through the apparatus to the output end thereof;

forming means along the path of travel to form wells in a conveyed web of plastic material;

dispensing means along the path of travel to dispense pills into the wells;

a second support for a web of rupturable material located above the linear path of travel to feed rupturable material onto the plastic material for movement therewith in a two part laminate;

tray means for a stack of cards laterally offset from the path of travel, the cards being formed with apertures;

conveyor means to sequentially feed cards from the support means to a location adjacent to the web of plastic material and then into contact therewith;

coupling means along the path of travel to couple the plastic material with the cards to form a three part laminate; and cutting means along the linear path of travel to cut the laminate for forming individual blister packs; and rail means positioned transverse to, and operatively associated with, the path of travel for supporting the cards at their edges, the rail means including narrowly spaced rails remote from the path of travel for receiving the cards and widely spaced rails below the path of travel to accommodate the coupling means and further including recesses formed in the widely spaced rails traverse the path of travel for allowing the wells formed in the web of plastic material to move along the path of travel.

3. The apparatus of claim 2 wherein the recesses are in two sets transverse to the path of movement to accommodate two transverse blister packs formed in the common web of material.

4. The apparatus of claim 2 and further including pick and place means in operable association with the rail means, the pick and place means is located transverse the path of travel and is adapted to sequentially pick information-bearing cards form a support means and to place the picked card onto the widely spaced rails adjacent to, but offset from, the path of travel.

5. The apparatus of claim 4 and further including piston means located beneath the rail means adapted to shift the placed card from a location on the widely spaced rails to a location on the narrowly spaced rails beneath the web of plastic material with the wells of the plastic material vertically aligned with the apertures of the card.

6. The apparatus of claim 2 wherein the stack of cards comprises a stack of composite card each having a plurality of individual blister pack cards thereon which have been formed en masse.

7. The apparatus of claim 6 wherein the cutting means comprises means to cut the composite card into a plurality of individual blister packs, the cutting means adapted to cut the composite card interior the edges of the composite card in a direction both transverse to and parallel with the path of travel to thereby leave the remains of the three part laminate for being received by a take-up roll.

8. For use in continuous and automatic machinery for forming blister packs as they move in a path of travel, the blister packs being of the type formed of plastic material with pill-receiving wells, a rupturable material thereabove, and pills sealed therebetween within the wells, apparatus to sequentially convey apertured information-bearing cards to the plastic material with the apertures aligned with the wells and to weld the information-bearing cards to the plastic material, the apparatus comprising:

a tray offset from the path of travel and adapted to support a plurality of cards with apertures in a stack;

pneumatic conveyor adapted to pick off the lowermost card in the tray and move the picked card to an intermediate location adjacent to, but offset from, the path of travel;

fixed support means having a first end beneath the intermediate location and a second end beneath the path of travel, the support means being configured to thereby allow support of cards thereon by their edges, the support means also including rails to support the plastic material, the rails having recesses to allow passage of the wells with respect to the rails;

piston means to sequentially shift cards from the first end to the second end;

lifting means beneath the support means adapted to raise a card at the second end into contact with the plastic material with the wells extending through the apertures; and ultrasonic welding means to couple the raised card to the plastic material to form a three-part laminate blister pack.

* * * * *